US011454467B2

(12) United States Patent
Kling et al.

(10) Patent No.: US 11,454,467 B2
(45) Date of Patent: Sep. 27, 2022

(54) BREECH DEVICE WITH INTEGRATED LINEARLY MOVABLE FIRING PIN PULSE GENERATOR

(71) Applicant: Carl Walther GmbH, Ulm (DE)

(72) Inventors: Martin Andreas Kling, Waldstetten (DE); Eyck Pflaumer, Arnsberg (DE); Martin Wonisch, Arnsberg (DE)

(73) Assignee: Carl Walther GmbH, Ulm (DE)

( * ) Notice: Subject to any disclaimer, the term of this patent is extended or adjusted under 35 U.S.C. 154(b) by 0 days.

(21) Appl. No.: 17/159,438

(22) Filed: Jan. 27, 2021

(65) Prior Publication Data

US 2021/0318085 A1 Oct. 14, 2021

(30) Foreign Application Priority Data

Mar. 25, 2020 (DE) ..... 10 2020 108 231.2

(51) Int. Cl.
*F41A 3/66* (2006.01)
*F41A 19/30* (2006.01)

(52) U.S. Cl.
CPC ..... *F41A 3/66* (2013.01); *F41A 19/30* (2013.01)

(58) Field of Classification Search
CPC ..... F41A 19/13; F41A 19/25; F41A 19/27; F41A 19/29
See application file for complete search history.

(56) References Cited

U.S. PATENT DOCUMENTS 2,717,464 A 9/1955 Marcati
5,604,326 A 2/1997 Lescure
9,518,791 B1 12/2016 Heizer et al.
2011/0041680 A1* 2/2011 Smirnov ..... F41A 19/12 42/2
2016/0231075 A1* 8/2016 Wolf ..... F41A 19/30

FOREIGN PATENT DOCUMENTS

EP 0786640 A1 7/1997
GB 500621 A 2/1939

OTHER PUBLICATIONS

German Office Action dated Dec. 9, 2020 for German Patent Application No. 10 2020 108 231.2.
Exploded drawing and parts list: "Creed", Jun. 8, 2016, Carl Walther GmbH, Ulm, Germany.
Exploded drawing and parts list: "PPQ", Jan. 11, 2018, Carl Walther GmbH, Ulm, Germany.
Exploded drawing and parts list: "PPX M1", Jul. 28, 2014, Carl Walther GmbH, Ulm, Germany.

* cited by examiner

*Primary Examiner* — J. Woodrow Eldred
(74) *Attorney, Agent, or Firm* — Bachman & LaPointe, P.C.

(57) ABSTRACT

A firearm breech device (100) has a breech body (110) with a lower part with functional elements for interaction with an upper part of a handle part of the firearm. A firing pin (130) is linearly movable within a bore (120) of the breech body (110) with a leading end face (111) adjacent to the cartridge chamber (200) of a barrel of the firearm. The firing pin can be propelled by means of a pulse generator (140) which is also linearly movable within the bore (120) from a retracted basic position into an advanced firing position. In the advanced firing position, an ignition pin (138) of the firing pin (130) strikes an ignition element of a cartridge (300) to fire a shot.

20 Claims, 2 Drawing Sheets

BREECH DEVICE WITH INTEGRATED LINEARLY MOVABLE FIRING PIN PULSE GENERATOR

CROSS-REFERENCE TO RELATED APPLICATION

Priority is claimed of German Patent Application No. DE102020108231.2, filed Mar. 25, 2020, and entitled "Breech Device with Integrated Linearly Movable Firing Pin Pulse Generator", the disclosure of which is incorporated by reference herein in its entirety as if set forth at length.

BACKGROUND

The invention relates to a breech device of a firearm (breech section of a slide) with a breech body with a lower part with functional elements for interaction with an upper region of a handle part (frame) of the firearm.

In breech devices of the type mentioned above, historically rotary mounted hammers that were directly pre-loadable by means of a spring were first used (e.g., the Colt~Government Model™ 1911). In order to minimize a mass shift with the associated center of gravity shift of the firearm as far as possible, firearms with linearly movable firing pins (e.g., the Walther™ Creed™ and PPX™) were used as a next step. With these weapons, however, the firing pin was still cocked by a rotary-mounted pulse generator.

The known breech devices all have the disadvantage that a mass shift in connection with firing a shot is still not limited to a minimum, so that functionality, safety, and accuracy are far from optimized.

SUMMARY

The object of the invention is therefore to create a breech device with which the functionality, safety and accuracy of a firearm are improved compared to the known firearms from the prior art with simplified handling.

For a breech device of the above-mentioned type, this object is achieved according to the invention in that a firing pin is linearly movable within a bore of the breech body with a leading end face adjacent to the cartridge chamber of a barrel of the firearm, which firing pin can be propelled by means of a pulse generator that is also linearly movable within the bore from a retracted base position into an advanced firing position, in which an ignition pin of the firing pin strikes an ignition element of a cartridge to fire a shot.

Preferred embodiments of the invention are the subject matter of the subordinate claims, the elements of which act in the sense of a further improvement of the approach to achieving the object underlying the invention.

In the breech device according to the invention, with the help of the combination of features whereby a firing pin is linearly movable within a bore of the breech body with a leading end face adjacent to the cartridge chamber of a barrel of the firearm, which firing pin can be propelled by means of a pulse generator that is also linearly movable within the bore from a retracted basic position into an advanced shooting position, in which an ignition pin of the firing pin strikes an ignition element of a cartridge to fire a shot, it is achieved that a mass shift required for firing is further reduced compared to the known breech devices in the prior art, so that functionality, safety and accuracy of a firearm concerned are increased.

According to a first preferred embodiment of the breech device according to the invention, it is provided that the firing pin is composed in one piece of a firing pin head and a firing pin body, wherein the firing pin head is linearly movable within the bore in a region of the breech body near the barrel and the firing pin body is mounted to be linearly movable along an inner surface of a sliding guide which is also arranged in the bore, and the pulse generator is mounted so as to be linearly movable along an outer surface of the sliding guide.

According to a first preferred embodiment of the breech device according to the invention, an insert body forming the end of the sliding guide remote from the barrel is positionally fixed within the bore of the breech body by means of a breech head forming the end of the breech body remote from the barrel, wherein an end of the sliding guide near the barrel is supported on a supporting surface remote from the barrel of a firing pin head protrusion at least indirectly adjacent to the inner wall of the bore and movably mounted within the bore.

The bore of the breech body preferably has four differently sized diameters, wherein the diameter of the bore part for guiding the ignition pin attached to the end of the firing pin head near the barrel is smaller than the diameter of the bore part for guiding the firing pin head, which bore part is smaller than the bore part for guiding the firing pin head protrusion, which bore part is smaller than the bore part for guiding the pulse generator.

Furthermore, an impact spring linearly accelerating the pulse generator is preferably supported on the one hand on a supporting edge of the insert body near the pulse generator and on the other hand on an inner surface of a cavity of the pulse generator, and the insert body itself is preferably positionally fixed in the bore by means of a closure cap in the bore that closes the bore at the end remote from the barrel.

The main spring, which implemented as a coil spring, and the pulse generator are preferably dimensioned so that the entire tensioned, i.e. compressed, main spring comes to lie in the cavity of the pulse generator. The sliding guide is preferably dimensioned to allow an expansion of the main spring to at least twice the length specified in the compressed state.

The length of the firing pin body preferably corresponds essentially to the length of the sliding guide. A movement of the firing pin body within the sliding guide as a response to an impulse from the impulse generator is, however, preferably limited by means of a firing pin body detent in the region of the end remote from the barrel which is implemented as a recess, in which a protrusion in the region of the end of the sliding guide remote from the barrel is linearly guided only between a front edge and a rear edge of the detent, wherein the detent is sufficiently wide that an expansion motion of the firing pin up to a stop surface within the bore is not obstructed.

According to a further preferred embodiment of the breech device according to the invention, the pulse generator contains a protrusion provided with a latching surface, wherein the latching surface acts together with a latching surface of a rotatably mounted pawl coupled to a trigger unit to hold the pulse generator in the retracted basic position.

The trigger unit coupled to a trigger is preferably designed so that the pawl is set in rotation when the trigger is operated for the purpose of firing a shot, wherein the latching surface of the pawl releases the latching surface of the protrusion of the pulse generator and the pulse generator accelerates towards the firing pin head by the action of the expanding firing spring. In the aftermath thereof, a leading end face of the pulse generator strikes a contact surface on the firing pin head to bring the firing pin and thus the ignition pin into an advanced firing position against the force of a firing pin spring.

The firing pin spring is preferably supported on the one hand on a contact surface within the bore of the breech body and on the other hand on a supporting surface of the firing pin head protrusion remote from the sliding guide.

The firing pin spring is designed to return the firing pin to the retracted base position, in which the contact surface of the firing pin protrusion is remote from the barrel and behind the surface of the bore part remote from the barrel for guiding the firing pin protrusion, wherein this surface preferably forms a limit on an expansion movement of the pulse generator.

Furthermore, the firing pin preferably has a non-circular shape in cross-section for the purpose of non-rotatable twist-proof mounting within the sliding guide and is linearly movably guided in a corresponding manner within a non-circular bore of the sliding guide which is correspondingly adapted in cross-section.

BRIEF DESCRIPTION OF THE DRAWINGS

The breech device according to the invention is explained below on the basis of a preferred embodiment, which is shown in the figures of the drawing. In the figures.

DETAILED DESCRIPTION

Figure 1:
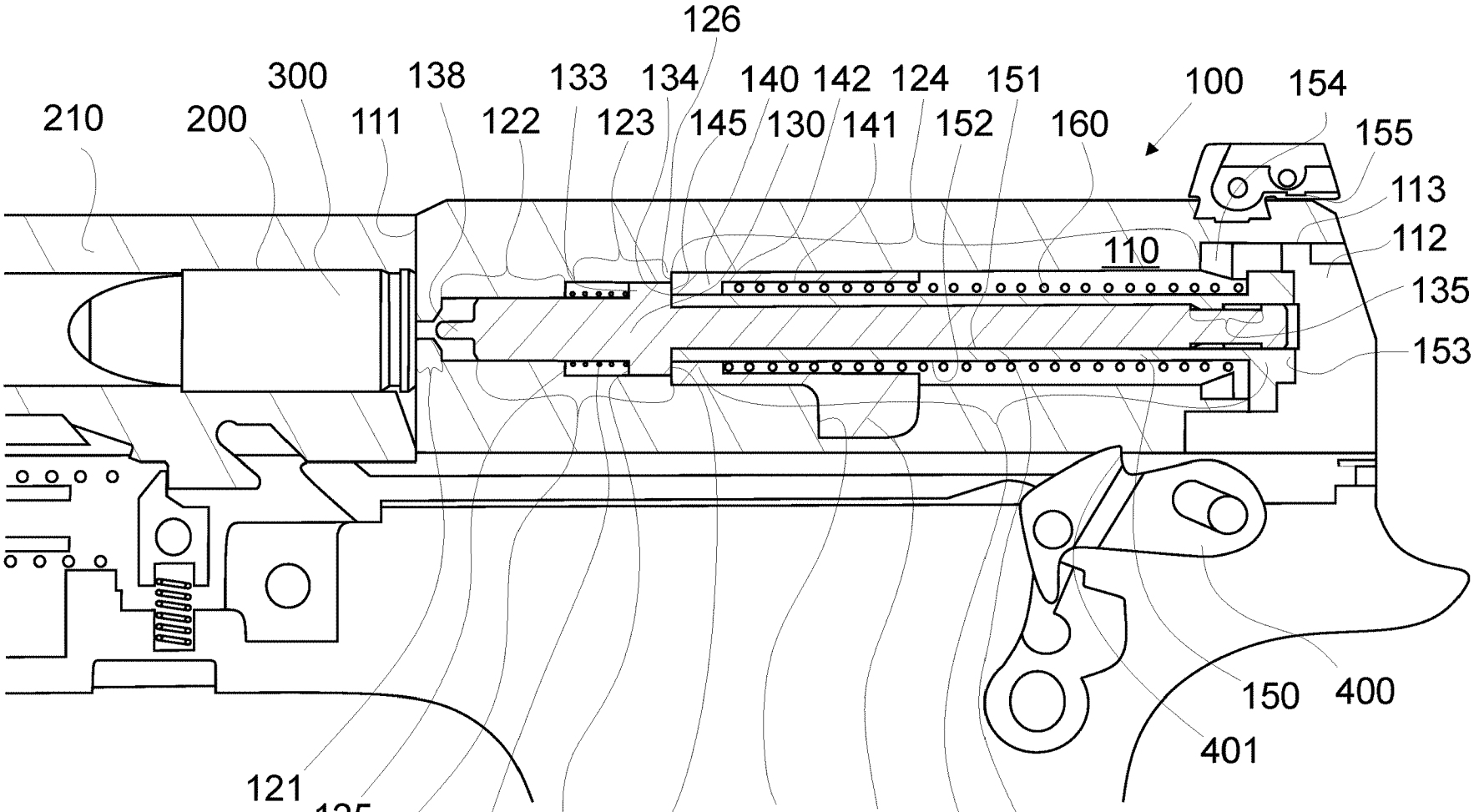
FIG. 1 shows a preferred embodiment of the breech device according to the invention in a first state in a side view.
Figure 2:
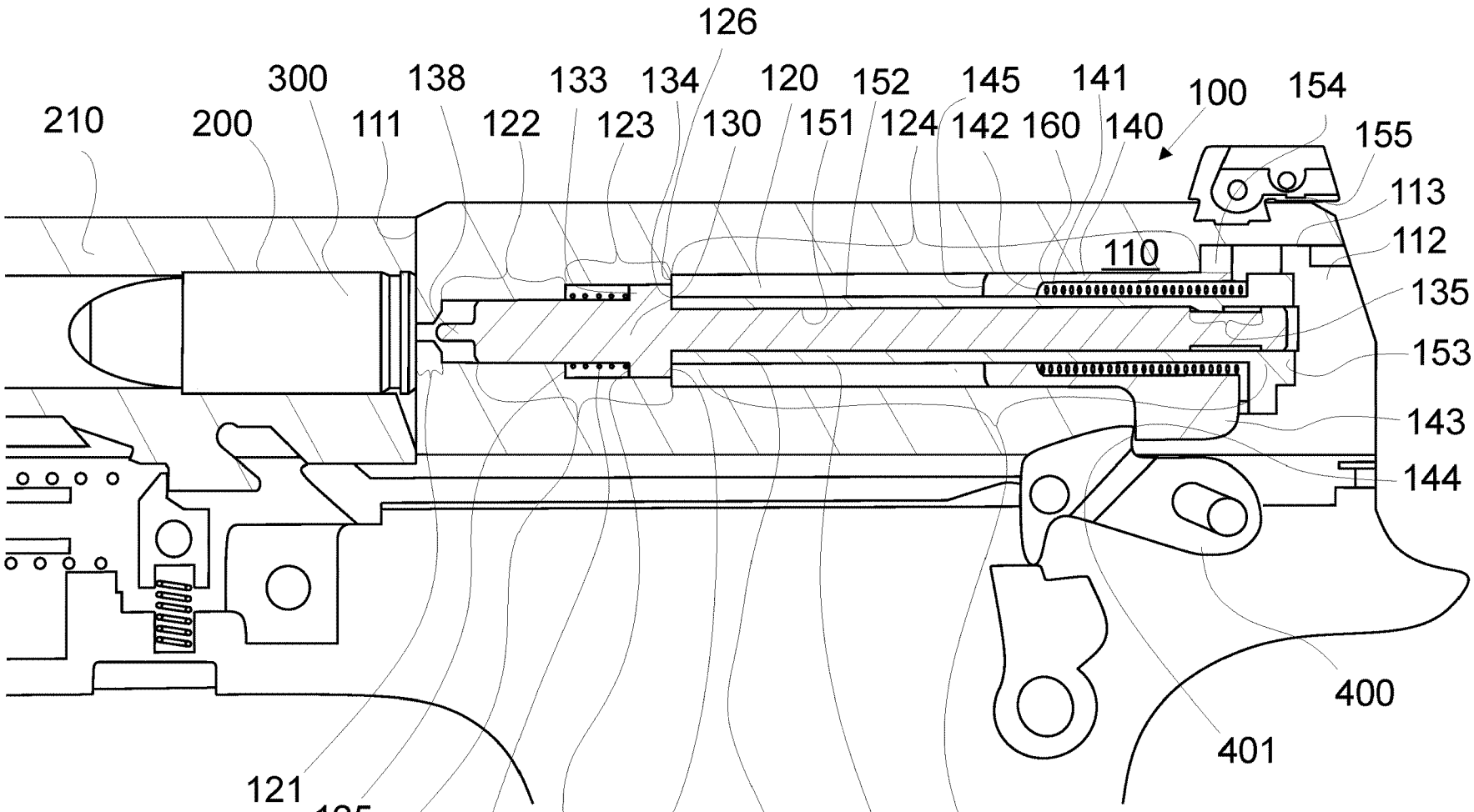
FIG. 2 shows the preferred embodiment of the breech device according to the invention shown in FIG. 1 in a second state in a side view.

The breech device 100 (breech section of the slide) according to the invention of a firearm shown in FIGS. 1 and 2 contains a breech body 110 with a lower part with functional elements for interaction with an upper region of a handle part (frame) of the firearm, wherein a firing pin is linearly movable 130 within a bore 120 of the breech body 110 with a leading end face 111 adjacent to the cartridge chamber 200 of a barrel 210 of the firearm.

The firing pin 130 is thereby propelled by means of a pulse generator 140 which is also linearly movable within the bore 120 from a retracted basic position into an advanced firing position, in which an ignition pin 138 of the firing pins 130 hits an ignition element (primer) of a cartridge 300 to fire a shot.

The firing pin 130 is composed in one piece of a firing pin head 131 and a firing pin body 132, wherein the firing pin head 131 is mounted linearly movably within the bore 120 in a region of the breech body 110 near the barrel and the firing pin body 132 is linearly movable along an inner surface 151 of a sliding guide 150 also arranged in the bore 120, and the pulse generator 140 is mounted linearly movably along an outer surface 152 of the sliding guide 150.

An insert body 153 of the sliding guide 150 forming the end of the sliding guide 150 remote from the barrel is positionally fixed within the bore 120 of the breech body 110 by means of a breech head 113 forming the end of the breech body 110 remote from the barrel, and an end of the sliding guide 150 near the barrel is supported on a supporting surface 134 remote from the barrel of a firing pin head protrusion 133 adjacent to the inner wall of the bore 120 and movably mounted within the bore 120.

The bore 120 of the breech body 110 has four different diameters, wherein the diameter 121 of the bore part for guiding the ignition pin 138 mounted on the end of the firing pin head 138 near the barrel is smaller than the diameter 121 of the bore part 122 for guiding the firing pin head 131, which bore part 122 is smaller than the bore part 123 for guiding the firing pin head protrusion 133, which bore part is smaller than the bore part 124 for guiding the pulse generator 140.

A firing spring 160 for linearly accelerating the pulse generator 140 is supported on a supporting edge of the insert body 154 near the impulse generator 140 on the one hand, and on the other hand on an inner surface 142 of a cavity 141 of the pulse generator 140. The insert body 154 is positionally fixed in the bore 120 by means of a closure cap 112 in the bore 120 that closes the bore 120 towards the end remote from the barrel.

The firing spring 160 is designed as a spiral spring, and the pulse generator 140 is dimensioned to accommodate the compressed firing spring 160 in the cavity 141. The sliding guide 150 is dimensioned in such a way that an expansion of the firing spring 160 to at least double the length specified in the clamped state can occur.

The length of the firing pin body 132 is essentially equal to the length of the sliding guide 150. A movement of the firing pin body 132 is limited within the sliding guide 150 in response to an impulse from the impulse generator 140 by means of a detent 135 of the firing pin body 132 implemented as a recess in the region of the end remote from the barrel, in which a protrusion 155 of the sliding guide 150 formed in the region of the end of the sliding guide 150 remote from the barrel is linearly movably guided only between a front edge and a rear edge of the detent 135, wherein the detent is sufficiently wide that an expansion movement of the firing pin up to a stop surface 126 within the bore 120 is not obstructed.

The pulse generator 140 has a protrusion 143 provided with a latching surface 144, wherein the latching surface 144 interacts with a latching surface 401 of a rotatably mounted pawl 400 coupled to a trigger unit to hold the pulse generator 140 in the retracted basic position.

The trigger unit coupled to a trigger sets the pawl 400 rotating when the trigger is operated for the purpose of firing, wherein the latching surface 401 of the pawl 400 releases the latching surface 144 of the protrusion 143 of the pulse generator 140 and the pulse generator 140 is accelerated towards the firing pin head 131 by the action of the expanding firing spring 160 and a leading end face 145 of the pulse generator 140 strikes a contact surface 136 on the firing pin head 131 to bring the firing pin 130 and thus the ignition pin 138 into an advanced firing position against the force of a firing pin spring 170.

On the one hand, the firing pin spring 170 is supported on a contact surface 125 within the bore 120 of the breech body 110 and on the other hand on a supporting surface 137 of the firing pin head protrusion 133 remote from the sliding guide 150.

The firing pin spring returns the firing pin 130 to the retracted basic position, in which the contact surface 136 of the firing pin protrusion 133 is located remotely from the barrel behind the surface of the bore part 123 which is remote from the barrel for guiding the firing pin protrusion 133, wherein this surface forms a limit on an expansion movement of the pulse generator 140.

The firing pin 130 has a non-circular shape in cross-section for the purpose of a non-rotatable, twist-proof mounting within the sliding guide 150 and is thereby linearly movably guided within the predetermined limits within a non-circular bore 156 of the sliding guide 150 corresponding to this shape in cross-section.

The embodiment of the invention explained above serves only the purpose of a better understanding of the teaching prescribed by the claims, which as such is not restricted by the embodiment.

LIST OF REFERNCE SIGNS

Below is a list of reference signs used in the drawings:

100 Breech device
110 Breech body
111 Leading end face of the breech body
112 Closure cap
113 Breech head
120 Bore of the breech body
121, 122, 123, 124 Parts with different diameters of the bore of the breech body
125 Contact surface of the firing pin spring
126 Stop surface
130 Firing pin
131 Firing pin head
132 Firing pin body
133 Firing pin head protrusion
134 Supporting surface of the firing pin head protrusion
135 Firing pin detent
136 Contact surface of the firing pin head
137 Supporting surface of the firing pin protrusion, remote from the sliding guide
138 Ignition pin
140 Pulse generator
141 Cavity of the pulse generator
142 Inner surface of the cavity of the pulse generator
143 Protrusion of the pulse generator
144 Latching surface of the pulse generator
145 Leading end face of the pulse generator
150 Sliding guide
151 Inner surface of the sliding guide
152 Outer surface of the sliding guide
153 Insert body of the sliding guide
154 Supporting edge of the insert body
155 Protrusion of the gliding guide
156 Bore of the sliding guide
160 Main spring
170 Firing pin spring
200 Cartridge chamber
210 Barrel
300 Cartridge
400 Pawl
401 Latching surface of the pawl

What is claimed is:

1. A breech device (100) of a firearm comprising:

a breech body (110) with a lower part with functional elements for interaction with an upper region of a handle part of the firearm; wherein:

a firing pin (130) is linearly movable within a bore (120) of the breech body (110) with a leading end face (111) adjacent to the cartridge chamber (200) of a barrel (210) of the firearm from a retracted basic position into an advanced firing position, in which an ignition pin (138) of the firing pin (130) strikes an ignition element of a cartridge (300) to fire a shot;

the firing pin can be propelled by means of a pulse generator (140) which is also linearly movable within the bore;

the firing pin (130) comprises a firing pin head (131) and a firing pin body (132);

the firing pin head (131) is mounted linearly movably within the bore (120) in a region of the breech body (110) close to the barrel;

the firing pin body (132) is mounted linearly movably along an inner surface (151) of a sliding guide (150) also arranged in the bore (120); and the pulse generator (140) is linearly movable along an outer surface (152) of the sliding guide (150).

2. The breech device (100) according to claim 1, characterized in that an insert body (153) of the sliding guide (150) forming the end of the sliding guide (150) remote from the barrel is positionally fixed within the bore (120) of the breech body (110) by means of a breech head (113) forming the end of the breech body (110) remote from the barrel and an end of the sliding guide (150) near the barrel is supported on a supporting surface (134) remote from the barrel of a firing pin head protrusion (133) at least indirectly adjacent to the inner wall of the bore (120) and movably mounted within the bore (120).

3. The breech device (100) according to claim 2, characterized in that the bore (120) of the breech body (110) has four different diameters, wherein the diameter (121) of the bore part for guiding the ignition pin (138) mounted on the end of the firing pin head (131) near the barrel is smaller than the diameter of the bore part (122) for guiding the firing pin head (131), which bore part (122) is smaller than the bore part (123) for guiding the firing pin head protrusion (133), which bore part (123) is smaller than the bore part (124) for guiding the pulse generator (140).

4. The breech device (100) according to claim 3, characterized in that a firing spring (160) for linearly accelerating the pulse generator (140) is supported on the one hand on a supporting edge of the insert body (154) near the pulse generator (140) and on the other hand on an inner surface (142) of a cavity (141) of the pulse generator (140).

5. The breech device (100) according to claim 4, characterized in that the insert body (153) is positionally fixed by means of a closure cap (120) closing the bore (120) at the far end remote from the barrel.

6. The breech device (100) according to claim 5, characterized in that the firing spring (160) is designed as a spiral spring and the pulse generator (140) is dimensioned to accommodate the clamped firing spring (160) in the cavity (141).

7. The breech device (100) according to claim 6, characterized in that the sliding guide (150) is dimensioned to allow an expansion of the firing spring (160) to at least twice the length specified in the clamped state.

8. The breech device (100) according to claim 7, characterized in that the length of the firing pin body (132) essentially corresponds to the length of the sliding guide (150).

9. The breech device (100) according to claim 8, characterized in that a movement of the firing pin body (132) within the sliding guide (150) as a response to an impulse from the pulse generator (140) is limited by means of a detent (135) implemented as a recess in the region of the end remote from the barrel of the firing pin body (132), in which a protrusion (155) of the sliding guide (155) formed in the region of the sliding guide (155) remote from the barrel is linearly movably guided only between a front edge and a rear edge of the detent (135), wherein the detent is sufficiently wide that an expansion motion of the firing pin up to a stop surface (126) within the bore (120) is not obstructed.

10. The breech device (100) according to claim 2, characterized in that a firing spring (160) for linearly accelerating the pulse generator (140) is supported on the one hand on a supporting edge of the insert body (154) near the pulse generator (140) and on the other hand on an inner surface (142) of a cavity (141) of the pulse generator (140).

11. The breech device (100) according to claim 10, characterized in that the insert body (153) is positionally fixed by means of a closure cap (120) closing the bore (120) at the far end remote from the barrel.

12. The breech device (100) according to claim 11, characterized in that the firing spring (160) is designed as a spiral spring and the pulse generator (140) is dimensioned to accommodate the clamped firing spring (160) in the cavity (141).

13. The breech device (100) according to claim 12, characterized in that the sliding guide (150) is dimensioned to allow an expansion of the firing spring (160) to at least twice the length specified in the clamped state.

14. The breech device (100) according to claim 13, characterized in that the length of the firing pin body (132) essentially corresponds to the length of the sliding guide (150).

15. The breech device (100) according to claim 14, characterized in that a movement of the firing pin body (132) within the sliding guide (150) as a response to an impulse from the pulse generator (140) is limited by means of a detent (135) implemented as a recess in the region of the end remote from the barrel of the firing pin body (132), in which a protrusion (155) of the sliding guide (155) formed in the region of the sliding guide (155) remote from the barrel is linearly movably guided only between a front edge and a rear edge of the detent (135), wherein the detent is sufficiently wide that an expansion motion of the firing pin up to a stop surface (126) within the bore (120) is not obstructed.

16. A method for operating the breech device (100) of claim 1, the method comprising:

linearly moving the pulse generator (140) from the retracted basic position into the advanced firing position; and the linear movement of the pulse generator causing the ignition pin (138) of the firing pin to strike the ignition element of the cartridge (300) to fire the shot.

17. The method of claim 16 wherein:

the linear movement of the pulse generator is driven by a firing spring (160); and the linear movement of the pulse generator causes the pulse generator to strike the firing pin to drive a linear movement of the firing pin from a retracted position of the firing pin to strike the ignition element.

18. The method of claim 17 wherein:

a return spring (170) biases the firing pin away from the cartridge toward the retracted position of the firing pin.

19. A firearm comprising:

a barrel (210) having a chamber (200);

a frame;

a slide having a breech body (110) the breech body having:

a lower part with functional elements for interaction with an upper region of the frame; and a leading end face (111) adjacent to the cartridge chamber (200);

a firing pin (130) linearly movable within a bore (120) of the breech body (110) from a retracted basic position into an advanced firing position, in which firing position an ignition pin (138) of the firing pin (130) strikes an ignition element of a cartridge (300) to fire a shot; and a pulse generator (140) which is also linearly movable within the bore (120), wherein:

the firing pin (130) has:

a firing pin head (131) from which the ignition pin (138) forwardly protrudes; and a firing pin body (132);

the firing pin body (132) is mounted linearly movably along an inner surface (151) of a sliding guide (150) also in the bore (120); and the pulse generator (140) is linearly movable along an outer surface (152) of the sliding guide (150).

20. The firearm of claim 19 further comprising:

a firing spring (160) for driving the pulse generator to strike the firing pin; and a return spring (170) biasing the firing pin away from the cartridge toward the retracted position of the firing pin.

* * * * *